US012114769B1

(12) United States Patent
Day et al.

(10) Patent No.: US 12,114,769 B1
(45) Date of Patent: Oct. 15, 2024

(54) CONVERTIBLE TABLE WITH INTEGRATED STORAGE

(71) Applicants: Christopher James Day, Huntersville, NC (US); Rome Elizabeth Dunn, Huntersville, NC (US)

(72) Inventors: Christopher James Day, Huntersville, NC (US); Rome Elizabeth Dunn, Huntersville, NC (US)

( * ) Notice: Subject to any disclaimer, the term of this patent is extended or adjusted under 35 U.S.C. 154(b) by 94 days.

(21) Appl. No.: 18/095,062

(22) Filed: Jan. 10, 2023

(51) Int. Cl.
*A47B 3/00* (2006.01)
*A47B 3/08* (2006.01)

(52) U.S. Cl.
CPC ..... *A47B 3/002* (2013.01); *A47B 3/08* (2013.01); *A47B 2003/0824* (2013.01); *A47B 2200/0035* (2013.01); *A47B 2200/0084* (2013.01)

(58) Field of Classification Search
CPC ..... A47B 3/002; A47B 3/08; A47B 2009/006; A47B 2063/0824; A47B 2200/0035; A47B 2200/0084
See application file for complete search history.

(56) References Cited

U.S. PATENT DOCUMENTS 5,055,081 A * 10/1991 Nayak ..... A63H 33/04 108/26
5,280,753 A 1/1994 Kavanagh
5,551,558 A * 9/1996 Bureau ..... B62B 1/20 312/258
5,592,884 A * 1/1997 Glick ..... A47B 37/00 108/91
6,003,450 A 12/1999 Bruckner
6,321,662 B1 * 11/2001 Fraise ..... B65F 1/10 108/26
D461,061 S 8/2002 Kent
6,739,670 B2 5/2004 Johnson
8,245,649 B1 * 8/2012 Ratliff ..... A47D 3/00 108/156
D717,084 S 11/2014 Vogler
8,978,294 B2 * 3/2015 Adams ..... A47G 7/041 47/39
9,629,474 B2 * 4/2017 Wilson ..... A47D 3/005
10,905,231 B1 * 2/2021 Horowitz ..... A47B 91/02
11,096,487 B2 8/2021 Hazarian
11,622,621 B2 * 4/2023 Obioha ..... A47B 3/10 108/115
2009/0050033 A1 2/2009 Koch
2011/0221240 A1 9/2011 Shen
2013/0160679 A1 6/2013 Hathaway
2020/0154877 A1 * 5/2020 Hurley ..... A47B 3/083

FOREIGN PATENT DOCUMENTS

WO 9852441 11/1998

* cited by examiner

*Primary Examiner* — Daniel J Rohrhoff
(74) *Attorney, Agent, or Firm* — Kyle A. Fletcher, Esq.

(57) ABSTRACT

The convertible table with integrated storage comprises a tabletop, a base, a plurality of folding legs, and a plurality of pivoting legs. The convertible table with integrated storage may be a multi-function conversion table with internal storage. The base may be coupled to the underside of the tabletop. The convertible table with integrated storage may be operable as a toddler play table with the base resting on the floor, a child's play table with the base elevated above the floor by the plurality of pivoting legs, and an adult table with the base elevated above the floor by the plurality of folding legs. The base may comprise a storage area that may be accessible via an access aperture in the tabletop.

18 Claims, 10 Drawing Sheets

CONVERTIBLE TABLE WITH INTEGRATED STORAGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of convertible furniture and furniture with internal storage, more specifically, a convertible table with integrated storage.

SUMMARY OF INVENTION

The convertible table with integrated storage comprises a tabletop, a base, a plurality of folding legs, and a plurality of pivoting legs. The convertible table with integrated storage may be a multi-function conversion table with internal storage. The base may be coupled to the underside of the tabletop. The convertible table with integrated storage may be operable as a toddler play table with the base resting on the floor, a child's play table with the base elevated above the floor by the plurality of pivoting legs, and an adult table with the base elevated above the floor by the plurality of folding legs. The base may comprise a storage area that may be accessible via an access aperture in the tabletop.

An object of the invention is to provide a tabletop coupled to a base where the base comprises a storage area that is accessible through an access aperture in the tabletop when not covered by an access door.

Another object of the invention is to provide a plurality of folding legs that may be operable to elevate the tabletop to a height that is appropriate for use by an adult.

A further object of the invention is to provide a plurality of pivoting legs that may be operable to elevate the tabletop to a height that is appropriate for use by a child.

Yet another object of the invention is to provide a retaining strap that may couple to the base via a plurality of strap rings such that the invention may be strapped to a stable surface where a non-limiting example of the stable surface may comprise an ottoman.

These together with additional objects, features and advantages of the convertible table with integrated storage will be readily apparent to those of ordinary skill in the art upon reading the following detailed description of the presently preferred, but nonetheless illustrative, embodiments when taken in conjunction with the accompanying drawings.

In this respect, before explaining the current embodiments of the convertible table with integrated storage in detail, it is to be understood that the convertible table with integrated storage is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the convertible table with integrated storage.

It is therefore important that the claims be regarded as including such equivalent construction insofar as they do not depart from the spirit and scope of the convertible table with integrated storage. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
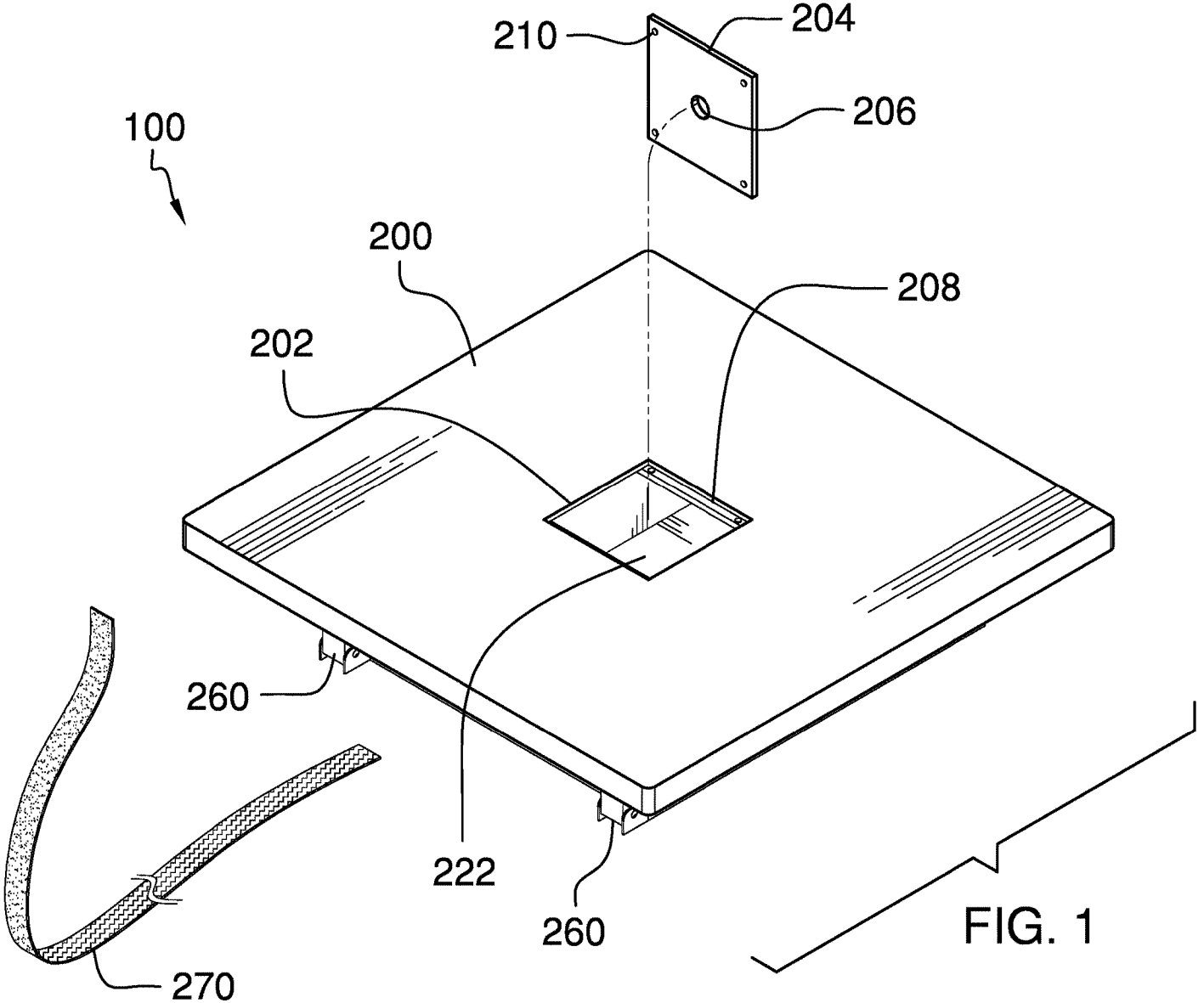
FIG. 1 is an isometric view of an embodiment of the disclosure.
Figure 2:
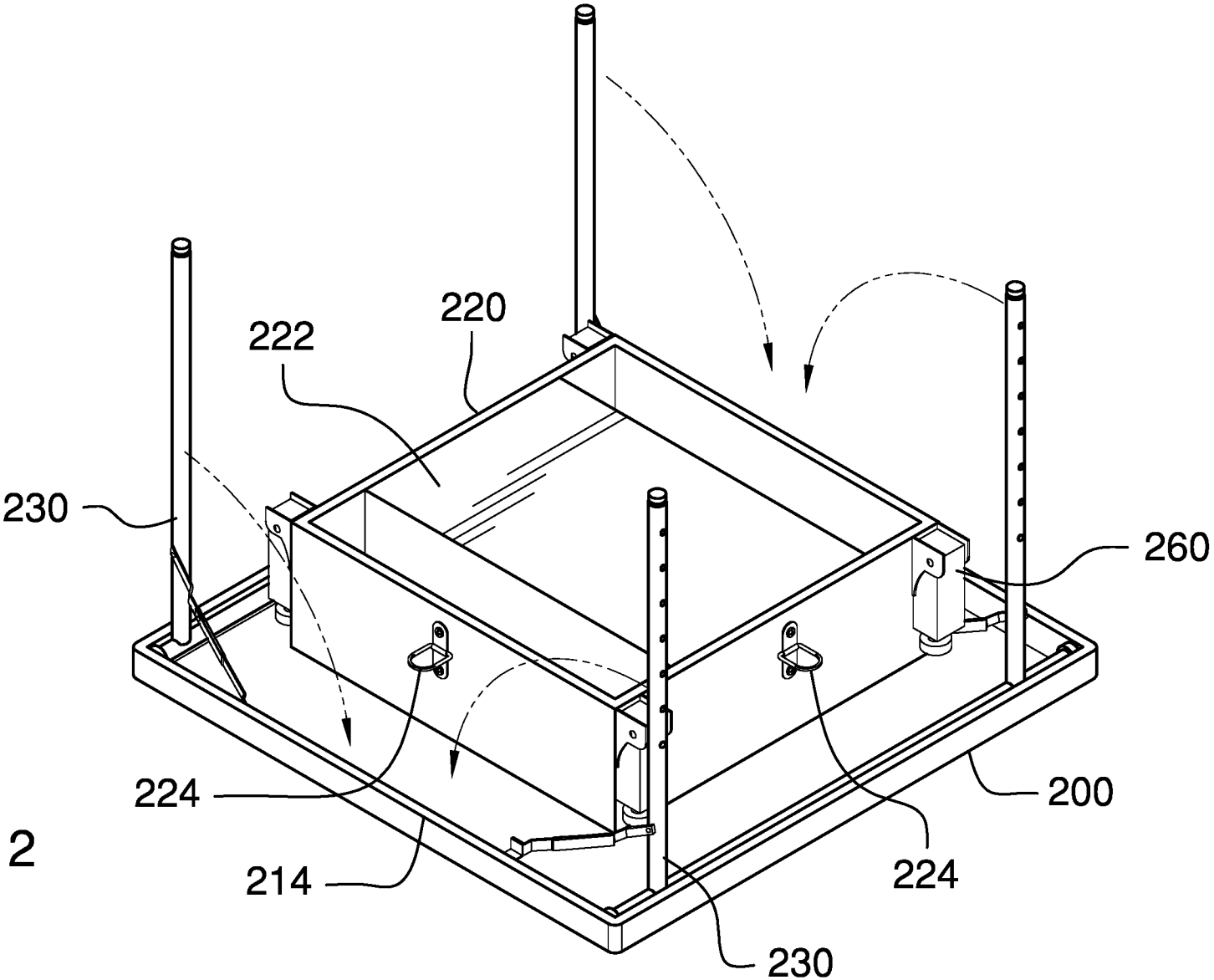
FIG. 2 is a bottom isometric view of an embodiment of the disclosure.
Figure 3:
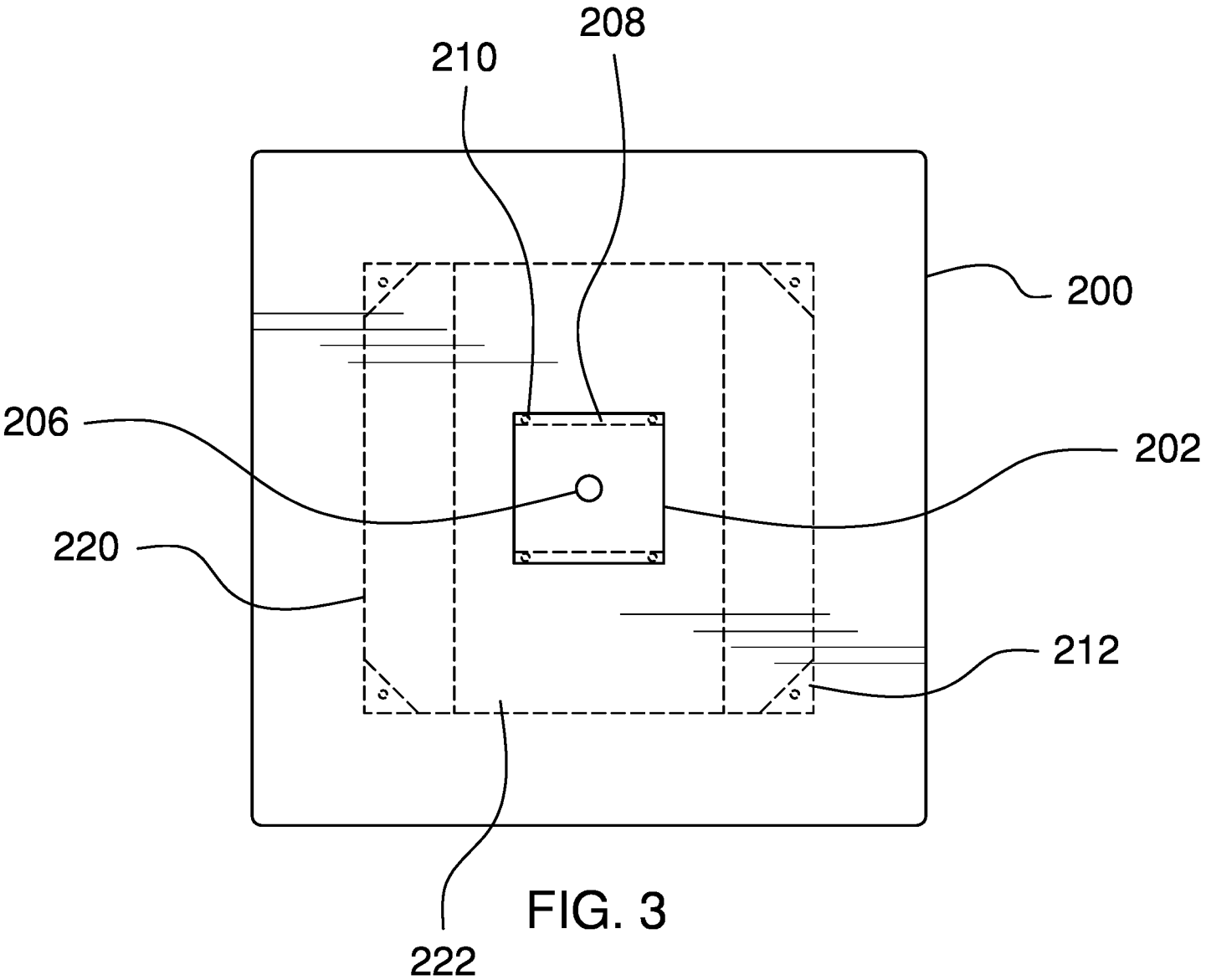
FIG. 3 is a top view of an embodiment of the disclosure.
Figure 4:
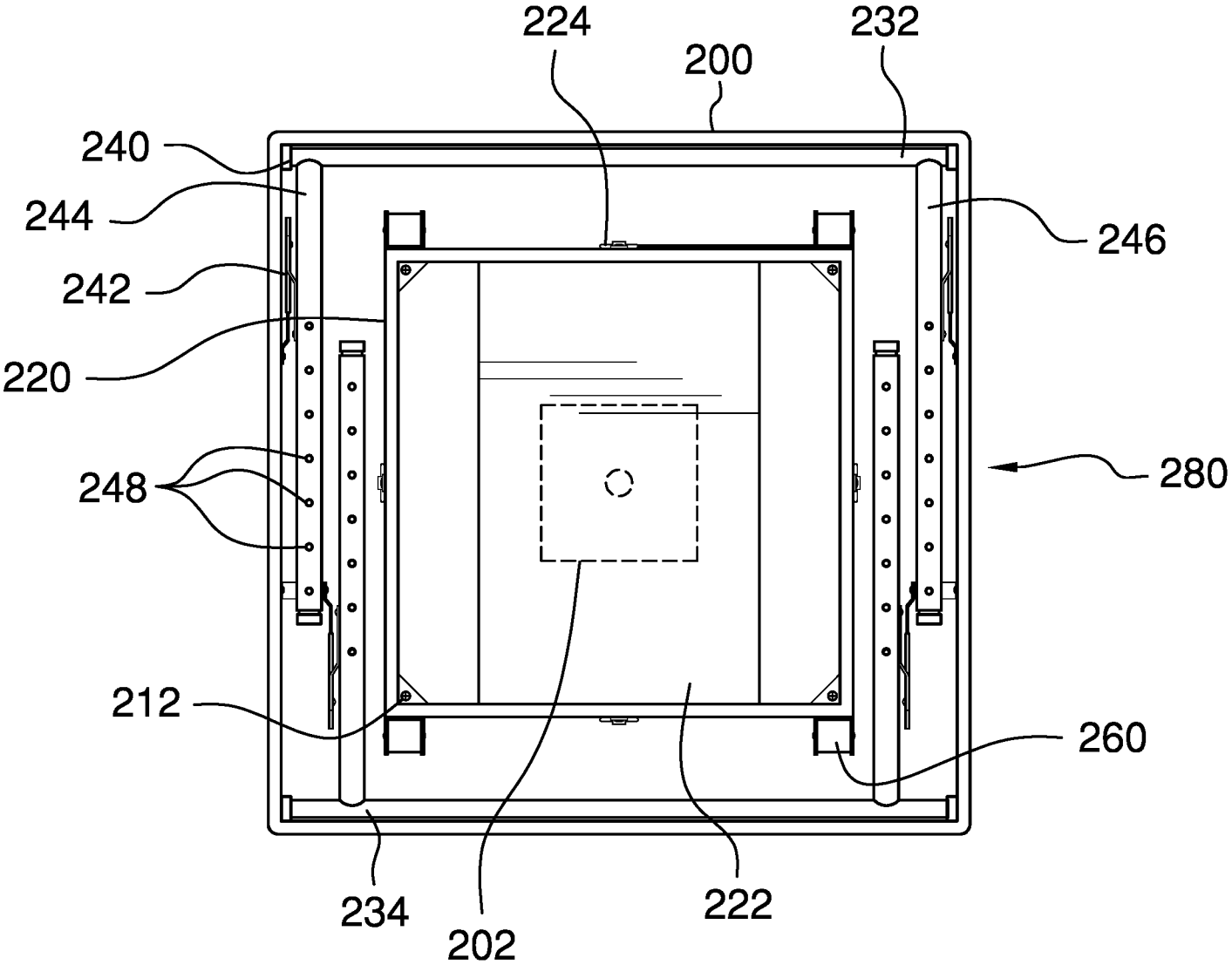
FIG. 4 is a bottom view of an embodiment of the disclosure.
Figure 5:
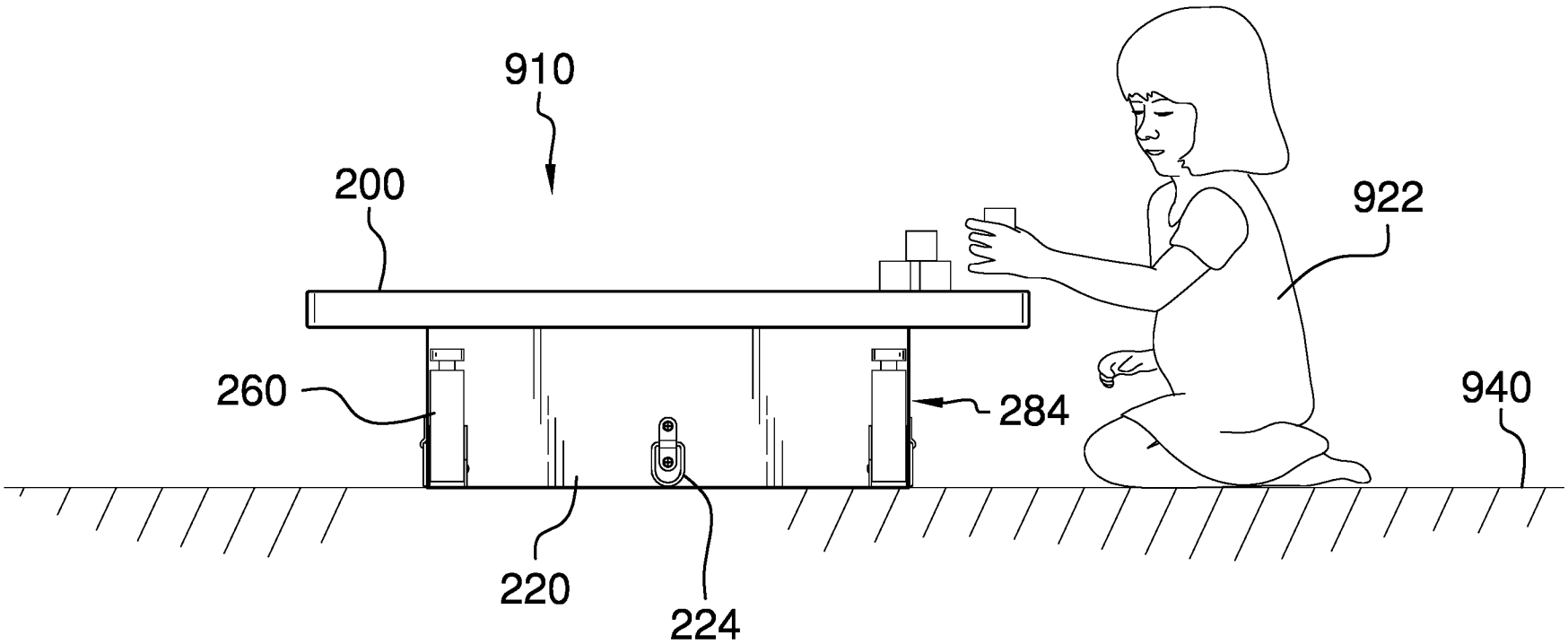
FIG. 5 is a side view of an embodiment of the disclosure, illustrating a toddler play table configuration.
Figure 6:
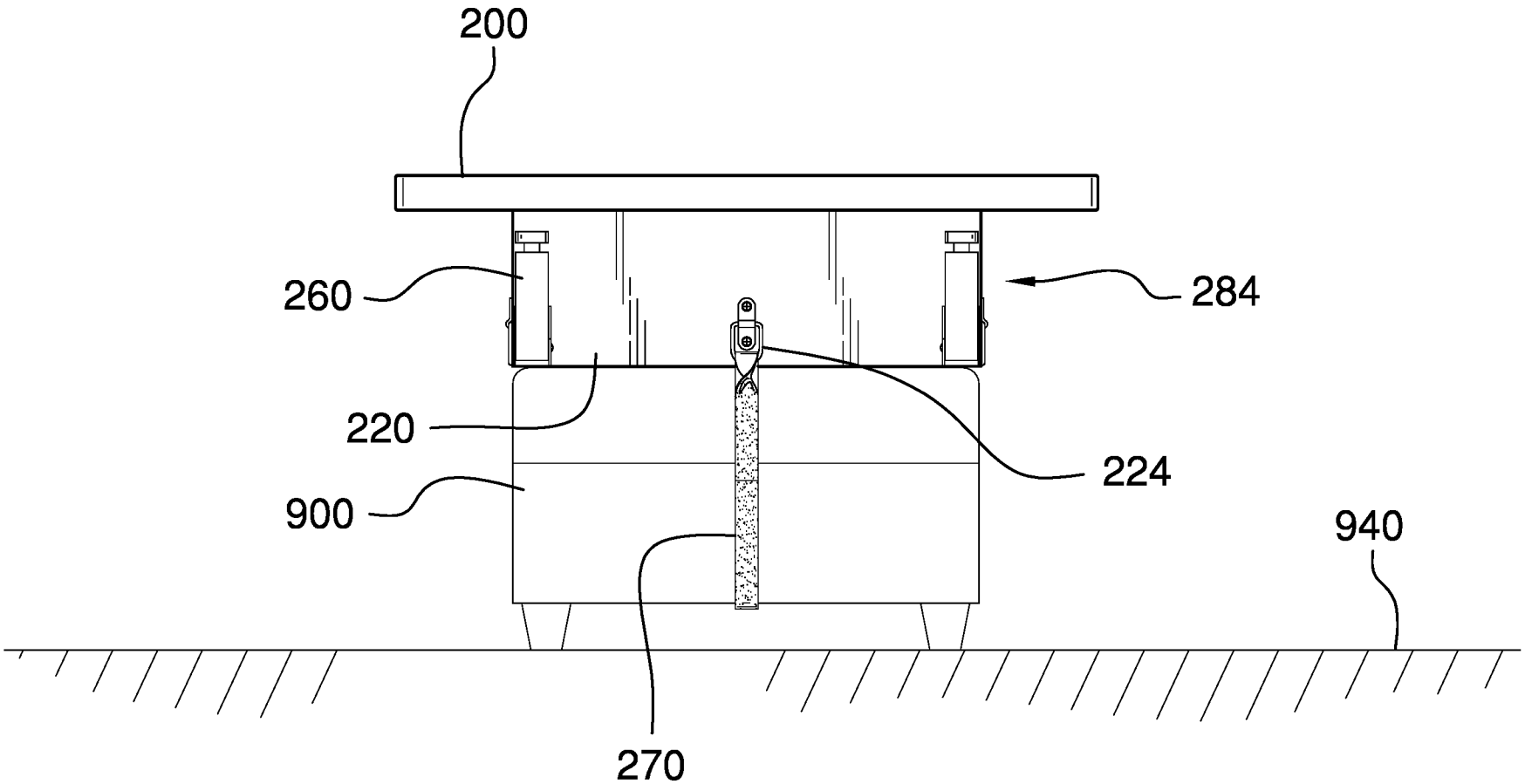
FIG. 6 is a side view of an embodiment of the disclosure, illustrating the invention strapped to an ottoman using the retaining strap.
Figure 7:
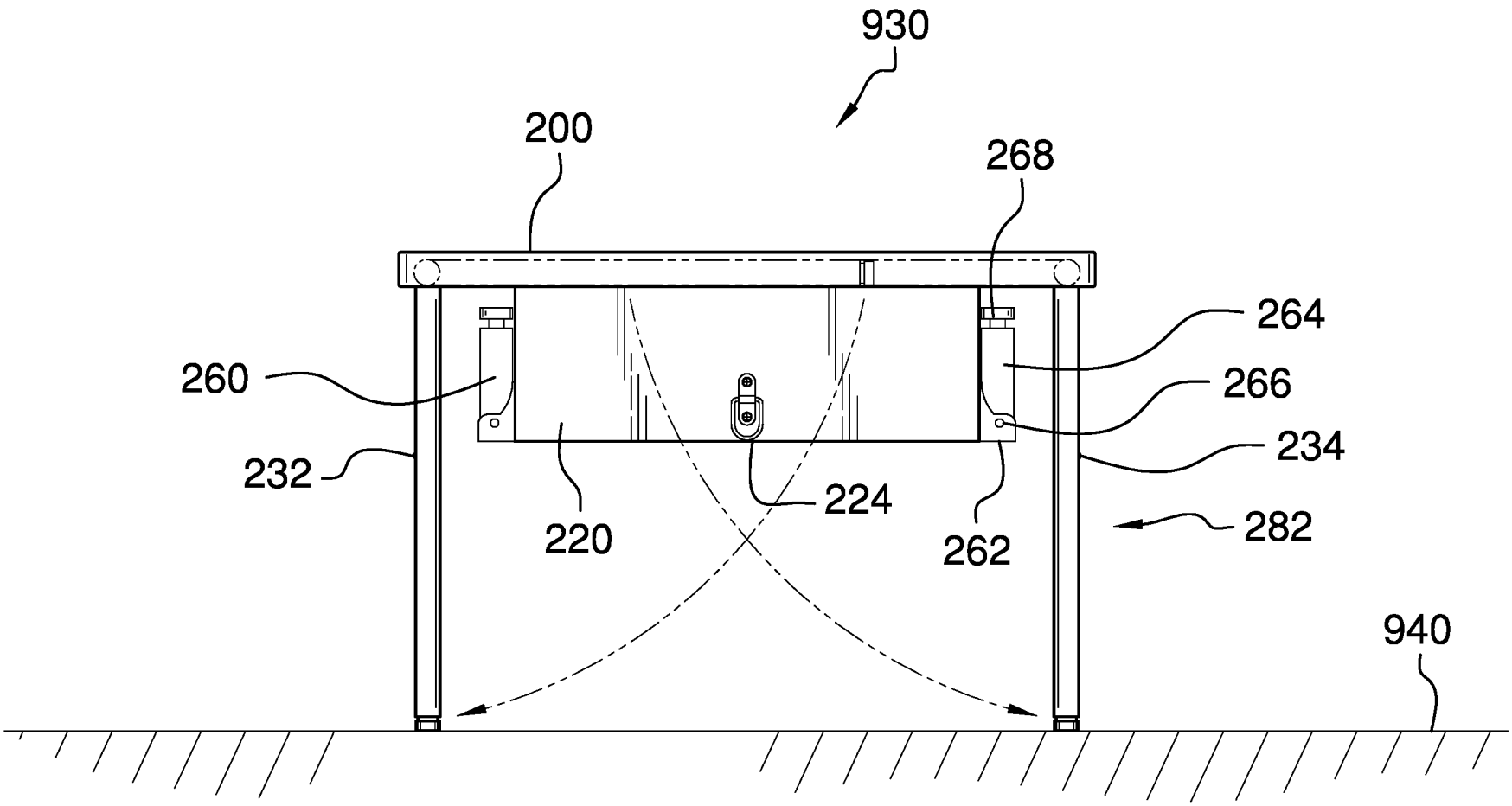
FIG. 7 is a side view of an embodiment of the disclosure illustrating an adult table configuration.
Figure 8:
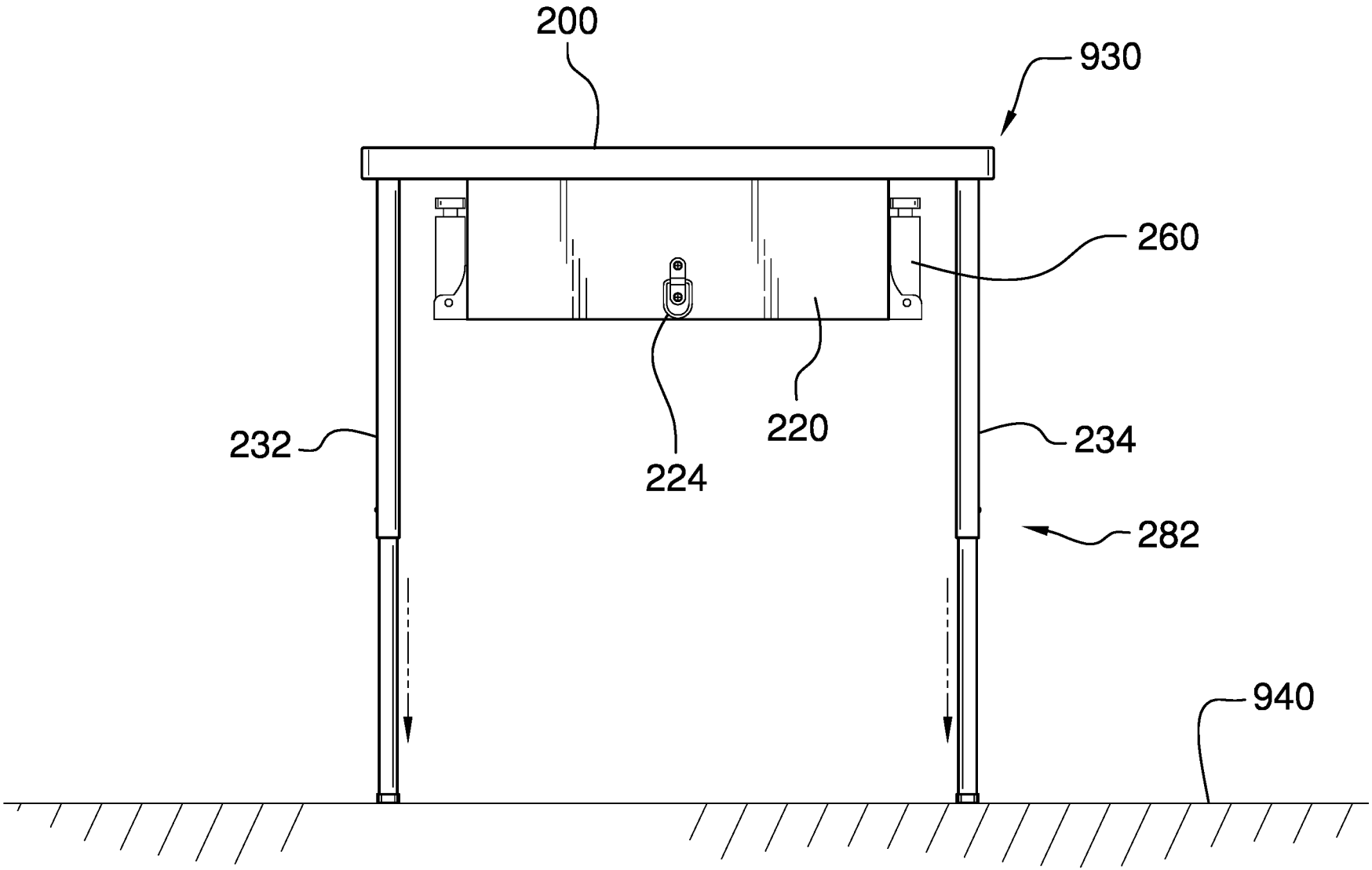
FIG. 8 is a side view of an embodiment of the disclosure illustrating the adult table configuration with folding legs maximally extended.
Figure 9:
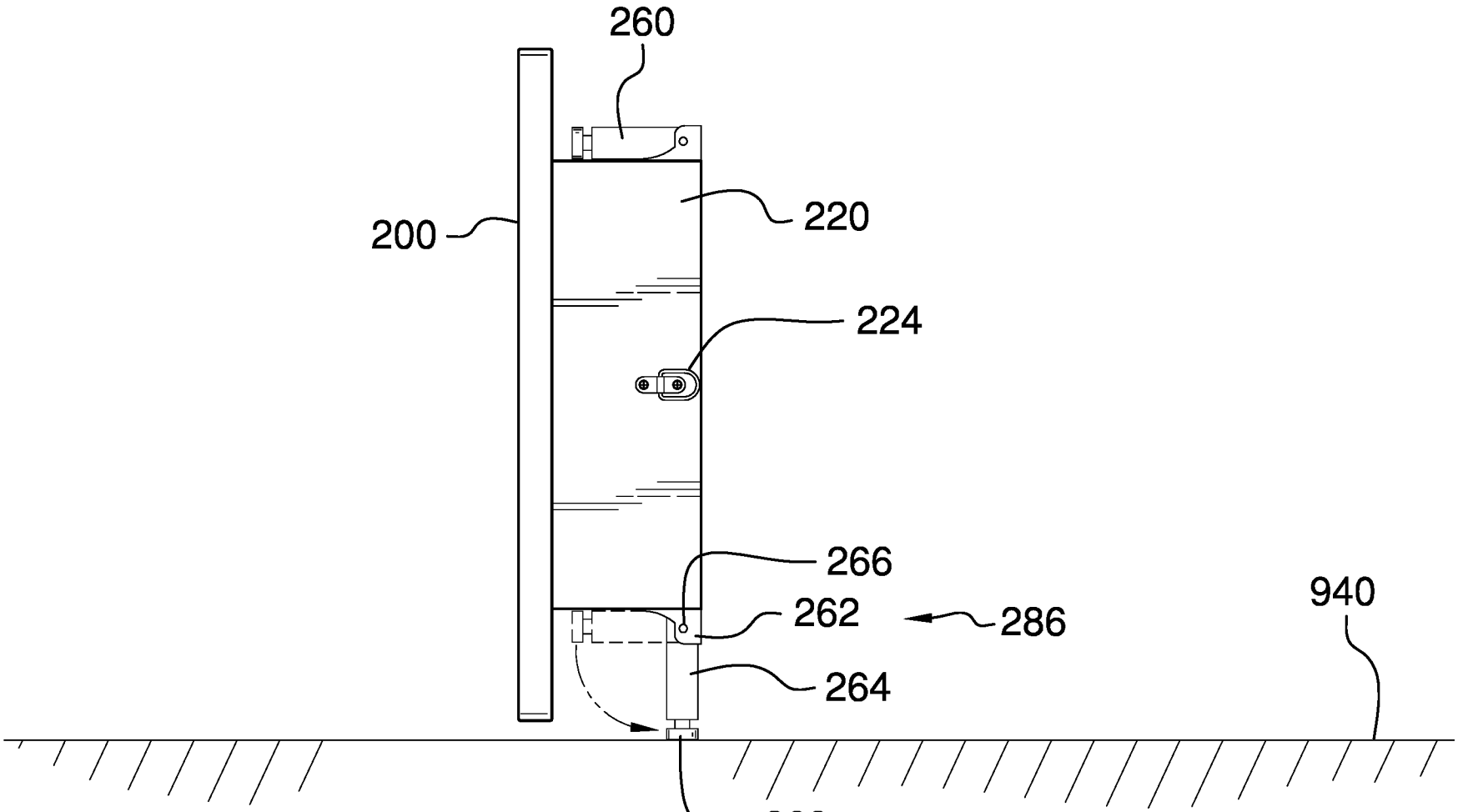
FIG. 9 is a side view of an embodiment of the disclosure illustrating the invention configured for storing when not in use.
Figure 10:
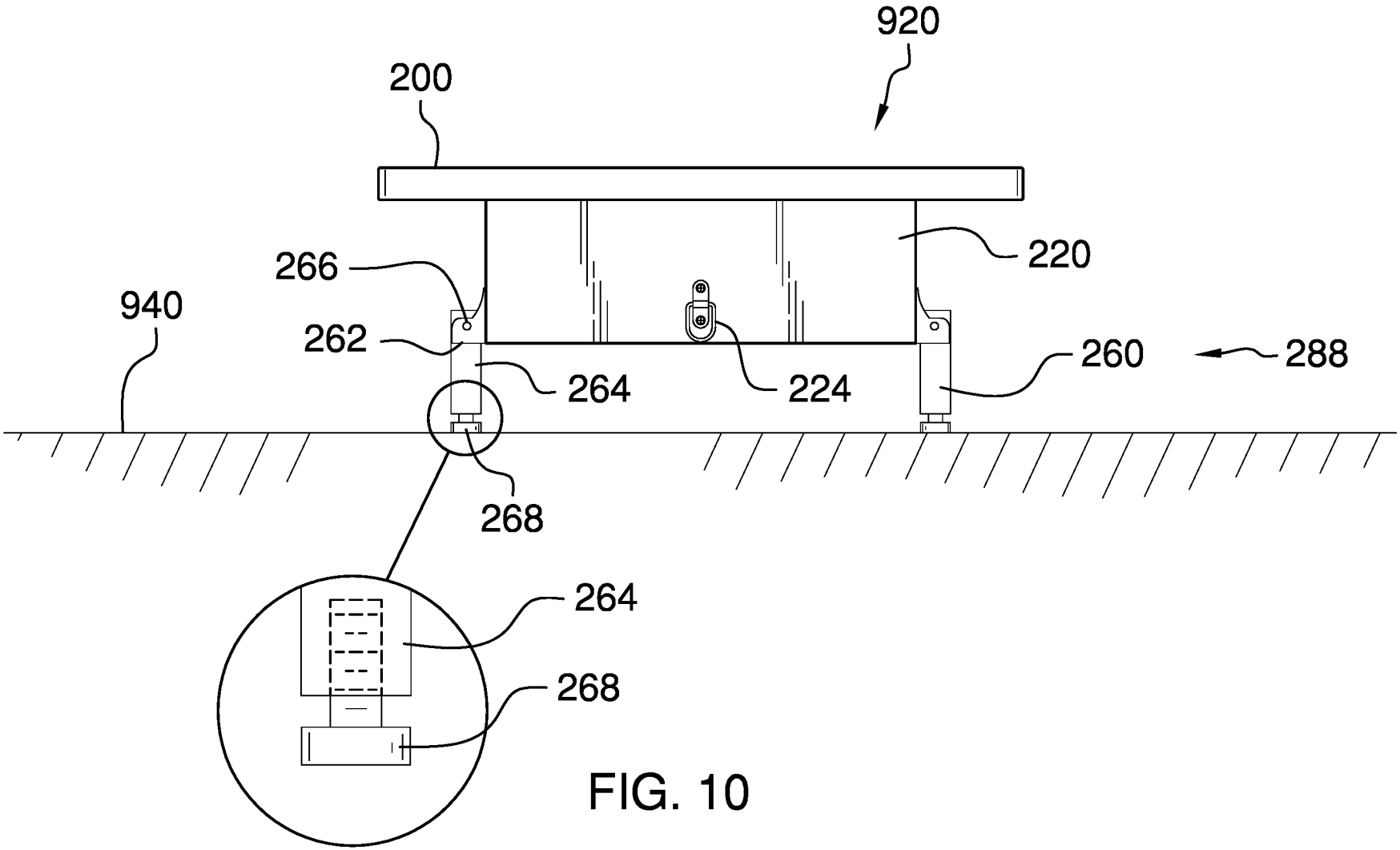
FIG. 10 is a side view of an embodiment of the disclosure illustrating a child play table configuration.

Detailed reference will now be made to a first potential embodiment of the disclosure, which is illustrated in FIGS. 1 through 10.

The convertible table with integrated storage 100 (hereinafter invention) comprises a tabletop 200, a base 220, a plurality of folding legs 230, and a plurality of pivoting legs 260. The invention 100 may be a multi-function conversion table with internal storage. The base 220 may be coupled to the underside of the tabletop 200. The invention 100 may be operable as a toddler play table 910 with the base 220 resting on the floor 940, a child's play table 920 with the base 220 elevated above the floor 940 by the plurality of pivoting legs 260, and an adult table 930 with the base 220 elevated above the floor 940 by the plurality of folding legs 230. The base 220 may comprise a storage area 222 that may be accessible via an access aperture 202 in the tabletop 200.

The tabletop 200 may be a horizontally-oriented square planar surface. As a non-limiting example, the tabletop 200 may be operable as a piece of furniture for dining or playing on. The tabletop 200 may comprise the access aperture 202 at the center of the tabletop 200. The access aperture 202 may be operable to provide access to the storage area 222 located within the base 220, below the tabletop 200.

The access aperture 202 may be covered by an access door 204. The access door 204 may be supported by a plurality of tabletop magnets 208 that may be mounted on the sides of the access aperture 202 at the bottom of the access aperture 202. The access door 204 may comprise a plurality of door magnets 210. The magnetic attraction between the plurality of tabletop magnets 208 and the plurality of door magnets 210 may hold the access door 204 in place until a removal force is applied to the access door 204. The access door 204 may comprise a central aperture 206 that may be adapted for a user's finger to be inserted in order to apply the removal force.

The tabletop 200 may comprise one or more tabletop mounting brackets 212 for coupling the tabletop 200 to the base 220. The tabletop 200 may comprise a tabletop lip 214. The tabletop lip 214 may extend downward from the perimeter of the tabletop 200 and may be operable to hide the plurality of folding legs 230 that may be coupled to the underside of the tabletop 200.

The base 220 may be a support structure coupled to the bottom of the tabletop 200. The base 220 may comprise a square footprint that is smaller than the footprint of the tabletop 200. The base 220 may be centered underneath the tabletop 200.

The base 220 may comprise the storage area 222. The storage area 222 may be an internal compartment of the base 220 that is accessible via the access aperture 202 in the tabletop 200. As non-limiting examples, the storage area 222 may be operable to hold magazines, coasters, games, flashlights, battery-operated candles, and more.

The plurality of folding legs 230 may be operable to maximally elevate the tabletop 200. The plurality of folding legs 230 may comprise a first set of folding legs 232 coupled to the underside of the tabletop 200 at the left end of the tabletop 200 and a second set of folding legs 234 coupled to the underside of the tabletop 200 at the right end of the tabletop 200. The first set of folding legs 232 and the second set of folding legs 234 may be interspersed such that the first set of folding legs 232 may operate free of interference from the second set of folding legs 234 and vice versa.

An individual set of folding legs selected from the first set of folding legs 232 and the second set of folding legs 234 may comprise one or more folding leg hinges 240, a first leg 244, a second leg 246, and one or more folding leg braces 242. The one or more folding leg hinges 240 may be operable to pivot the first leg 244 and the second leg 246 between a folding legs retracted position 280 and a folding legs extended position 282. In the folding legs retracted position 280, the individual set of folding legs may be oriented to be parallel to the tabletop 200. In the folding legs extended position 282, the individual set of folding legs may be oriented to be perpendicular to the tabletop 200. The one or more folding leg braces 242 may be operable to lock the individual set of folding legs into the folding legs extended position 282.

An individual leg selected from the first leg 244 and the second leg 246 may comprise a height adjuster 248 to vary the length of the individual leg. In the folding legs extended position 282, varying the length of the individual leg may vary the height of the tabletop 200.

The plurality of pivoting legs 260 may be operable to intermediately elevate the tabletop 200. The plurality of pivoting legs 260 may be coupled to corners of opposing sides of the base 220. Each of the plurality of pivoting legs 260 may pivot independently.

An individual pivoting leg selected from the plurality of pivoting legs 260 may comprise a pivoting leg mount 262, a pivoting leg armature 264, and a pivoting leg hinge 266. The pivoting leg mount 262 may couple the pivoting leg armature 264 to the base 220. The pivoting leg hinge 266 may be operable to pivot the pivoting leg armature 264 between a pivoting legs retracted position 284 and a pivoting legs extended position 288. In the folding legs retracted position 280, the pivoting leg armature 264 may be oriented to extend vertically upward such that the height of the tabletop 200 is unaffected by the individual pivoting leg. In the folding legs extended position 282, the pivoting leg armature 264 may be oriented to extend vertically downward such that the height of the tabletop 200 is raised by the individual pivoting leg. The distal end of the pivoting leg armature 264 may comprise a leveling foot 268 that may be operable to level the invention 100 by varying the length of the individual pivoting leg.

In some embodiments, the pivoting leg hinge 266 may be operable to pivot the pivoting leg armature 264 to a pivoting legs half-extended position 286 which may be located between the pivoting legs retracted position 284 and the pivoting legs extended position 288. In the pivoting legs half-extended position 286, the pivoting leg armature 264 may be oriented to extend horizontally such that the height of the tabletop 200 is unaffected by the individual pivoting leg. The pivoting legs half-extended position 286 may be operable to stabilize the invention 100 during storage on the side of the tabletop 200 by filling the gap between the base 220 and the floor 940.

The invention 100 may further comprise a retaining strap 270. The retaining strap 270 may be operable to hold the base 220 in place on top of a stable surface. The retaining strap 270 may detachably couple to two of a plurality of strap rings 224 that may be coupled to the sides of the base 220. The retaining strap 270 may couple to the plurality of strap rings 224 using hook and loop fasteners. As a non-limiting example, the stable surface may be an ottoman 900. The retaining strap 270 may also be referred to as a plurality of retaining straps 270 whereby multiple straps are used. It may also be worth noting that the retaining strap 270 may be referred to as at least one retaining strap 270.

In a preferred embodiment, the tabletop 200 may measure inches on each side, the base 220 may measure 24 inches on each side, and the height of the base 220 may be 8 inches high. In a preferred embodiment, the access door 204 may measure 8 inches on each side.

In use, the invention 100 may be placed on the floor 940 with the plurality of folding legs 230 in the folding legs retracted position 280 and with the plurality of pivoting legs 260 in the pivoting legs retracted position 284. Thus configured, the invention 100 may be operable as a toddler play table 910 where a toddler or a child 922 may play. Alternatively, the invention 100 may be placed on the floor 940 with the plurality of folding legs 230 in the folding legs retracted position 280 and with the plurality of pivoting legs 260 in the pivoting legs extended position 288. Thus configured, the invention 100 may be operable as a child's play table 920 where a child 922 may play. Alternatively, the invention 100 may be placed on the floor 940 with the plurality of folding legs 230 in the folding legs extended position 282 and with the plurality of pivoting legs 260 in the pivoting legs retracted position 284. Thus configured, the invention 100 may be operable as an adult table 930 where adults may dine, play cards, converse while consuming beverages, and so on. Alternatively, the invention 100 may be placed on a stable surface such as an ottoman 900 with the plurality of folding legs 230 in the folding legs retracted position 280 and with the plurality of pivoting legs 260 in the pivoting legs retracted position 284. The invention 100 may be secured in place by detachably coupling the retaining strap 270 to the base 220 after passing the retaining strap 270 beneath the stable surface.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "door" may be a movable or removable barrier that is attached to the wall of a room or the surface of a container for the purpose of allowing or preventing access through an aperture into the room or container.

As used here, "footprint" may refer to a projection of an object onto the surface that supports the object. The projection is usually, but not always, vertically downward.

As used herein, the terms "height adjustment" or "height adjuster" may refer to a mechanism that allows the overall height of an armature or stanchion to change by releasing a locking mechanism, adjusting a position, and re-engaging the locking mechanism. As a non-limiting example, the locking mechanism may comprise a plurality of holes in a first armature and a spring loaded pin on a second armature where the pin passes through one of the holes when the pin and the hole align. As a further non-limiting example, the locking mechanism may comprise a spring-loaded button on an inside armature that pops through one of a plurality of holes in an outside armature and which can be pressed into the hole to release the locking mechanism.

As used in this disclosure, a "hinge" may be a device that permits the turning, rotating, or pivoting of a first object relative to a second object.

As used in this disclosure, a "hook and loop fastener" may be a fastener that comprises a hook surface and a loop surface. The hook surface may comprise a plurality of minute hooks. The loop surface may comprise a surface of uncut pile that acts like a plurality of loops. When the hook surface is applied to the loop surface, the plurality of minute hooks may couple to the plurality of loops securely fastening the hook surface to the loop surface. The hook surface may sometime be referred to as a hard side fastener and the loop surface may sometimes be referred to as a soft side fastener.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, a "magnet" may be an ore, alloy, or other material that has its component atoms arranged so that the material exhibits properties of magnetism such as attracting iron-containing objects or aligning itself in an external magnetic field.

As used in this disclosure, a "perimeter" may be one or more curved or straight lines that bound an enclosed area on a plane or surface. The perimeter of a circle is commonly referred to as a circumference.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 10, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A convertible table with integrated storage comprising:

a tabletop, a base, a plurality of folding legs, and a plurality of pivoting legs;

wherein the convertible table with integrated storage is a multi-function conversion table with internal storage;

wherein the base is coupled to the underside of the tabletop;

wherein the convertible table with integrated storage is operable as a toddler play table with the base resting on the floor, a child's play table with the base elevated above the floor by the plurality of pivoting legs, and an adult table with the base elevated above the floor by the plurality of folding legs;

wherein the base comprises a storage area that is accessible via an access aperture in the tabletop;

wherein the tabletop comprises the access aperture at the center of the tabletop;

wherein the access aperture is operable to provide access to the storage area located within the base, below the tabletop;

wherein the access aperture is covered by an access door;

wherein the access door is supported by a plurality of tabletop magnets that are mounted on the sides of the access aperture at the bottom of the access aperture;

wherein the access door comprises a plurality of door magnets;

wherein the magnetic attraction between the plurality of tabletop magnets and the plurality of door magnets holds the access door in place until a removal force is applied to the access door.

2. The convertible table with integrated storage according to claim 1 wherein the tabletop is a horizontally-oriented square planar surface.

3. The convertible table with integrated storage according to claim 2 wherein the access door comprises a central aperture that is adapted for a user's finger to be inserted in order to apply the removal force.

4. The convertible table with integrated storage according to claim 3 wherein the tabletop comprises one or more tabletop mounting brackets for coupling the tabletop to the base.

5. The convertible table with integrated storage according to claim 4 wherein the tabletop comprises a tabletop lip;

wherein the tabletop lip extends downward from the perimeter of the tabletop and is operable to hide the plurality of folding legs that are coupled to the underside of the tabletop.

6. The convertible table with integrated storage according to claim 5 wherein the base is a support structure coupled to the bottom of the tabletop;

wherein the base comprises a square footprint that is smaller than the footprint of the tabletop;

wherein the base is centered underneath the tabletop.

7. The convertible table with integrated storage according to claim 6 wherein the base comprises the storage area;

wherein the storage area is an internal compartment of the base that is accessible via the access aperture in the tabletop.

8. The convertible table with integrated storage according to claim 7 wherein the plurality of folding legs are operable to maximally elevate the tabletop;

wherein the plurality of folding legs comprise a first set of folding legs coupled to the underside of the tabletop at the left end of the tabletop and a second set of folding legs coupled to the underside of the tabletop at the right end of the tabletop;

wherein the first set of folding legs and the second set of folding legs are interspersed such that the first set of folding legs operate free of interference from the second set of folding legs and vice versa.

9. The convertible table with integrated storage according to claim 8 wherein an individual set of folding legs selected from the first set of folding legs and the second set of folding legs comprise one or more folding leg hinges, a first leg, a second leg, and one or more folding leg braces;

wherein the one or more folding leg hinges are operable to pivot the first leg and the second leg between a folding legs retracted position and a folding legs extended position;

wherein in the folding legs retracted position, the individual set of folding legs is oriented to be parallel to the tabletop;

wherein in the folding legs extended position, the individual set of folding legs is oriented to be perpendicular to the tabletop;

wherein the one or more folding leg braces are operable to lock the individual set of folding legs into the folding legs extended position.

10. The convertible table with integrated storage according to claim 9 wherein an individual leg selected from the first leg and the second leg comprise a height adjuster to vary the length of the individual leg;

wherein in the folding legs extended position, varying the length of the individual leg varies the height of the tabletop.

11. The convertible table with integrated storage according to claim 10 wherein the plurality of pivoting legs are operable to intermediately elevate the tabletop;

wherein the plurality of pivoting legs are coupled to corners of opposing sides of the base;

wherein each of the plurality of pivoting legs pivot independently.

12. The convertible table with integrated storage according to claim 11 wherein an individual pivoting leg selected from the plurality of pivoting legs comprises a pivoting leg mount, a pivoting leg armature, and a pivoting leg hinge;

wherein the pivoting leg mount couples the pivoting leg armature to the base;

wherein the pivoting leg hinge is operable to pivot the pivoting leg armature between a pivoting legs retracted position and a pivoting legs extended position;

wherein in the folding legs retracted position, the pivoting leg armature is oriented to extend vertically upward such that the height of the tabletop is unaffected by the individual pivoting leg;

wherein in the folding legs extended position, the pivoting leg armature is oriented to extend vertically downward such that the height of the tabletop is raised by the individual pivoting leg;

wherein the distal end of the pivoting leg armature comprises a leveling foot that is operable to level the convertible table with integrated storage by varying the length of the individual pivoting leg.

13. The convertible table with integrated storage according to claim 12 wherein the pivoting leg hinge is operable to pivot the pivoting leg armature to a pivoting legs half-extended position which is located between the pivoting legs retracted position and the pivoting legs extended position;

wherein in the pivoting legs half-extended position, the pivoting leg armature is oriented to extend horizontally such that the height of the tabletop is unaffected by the individual pivoting leg;

wherein the pivoting legs half-extended position is operable to stabilize the convertible table with integrated storage during storage on the side of the tabletop by filling the gap between the base and the floor.

14. The convertible table with integrated storage according to claim 13 wherein the convertible table with integrated storage further comprises at least one retaining strap;

wherein the at least one retaining strap is operable to hold the base in place on top of a stable surface;

wherein the at least one retaining strap detachably couples to two of a plurality of strap rings that are coupled to the sides of the base;

wherein the at least one retaining strap couples to the plurality of strap rings using hook and loop fasteners.

15. A convertible table with integrated storage comprising:

a tabletop, and a base;

wherein the convertible table with integrated storage is a multi-function conversion table with internal storage;

wherein the base is coupled to the underside of the tabletop;

wherein the base comprises a storage area that is accessible via an access aperture in the tabletop;

wherein the convertible table with integrated storage is operable as a toddler play table with the base resting on the floor;

wherein the tabletop comprises the access aperture at the center of the tabletop;

wherein the access aperture is operable to provide access to the storage area located within the base, below the tabletop;

wherein the access aperture is covered by an access door;

wherein the access door is supported by a plurality of tabletop magnets that are mounted on the sides of the access aperture at the bottom of the access aperture;

wherein the access door comprises a plurality of door magnets;

wherein the magnetic attraction between the plurality of tabletop magnets and the plurality of door magnets holds the access door in place until a removal force is applied to the access door;

wherein the tabletop comprises a tabletop lip.

16. The convertible table with integrated storage according to claim 15 wherein a plurality of folding legs, and a plurality of pivoting legs are affixed to the base;

wherein the convertible table with integrated storage is further operable with the base elevated above the floor by the plurality of pivoting legs, and an adult table with the base elevated above the floor by the plurality of folding legs;

wherein the tabletop is a horizontally-oriented square planar surface.

17. The convertible table with integrated storage according to claim 16 wherein the tabletop lip extends downward from the perimeter of the tabletop and is operable to hide the plurality of folding legs that are coupled to the underside of the tabletop;

wherein the plurality of folding legs are operable to maximally elevate the tabletop;

wherein the plurality of folding legs comprise a first set of folding legs coupled to the underside of the tabletop at the left end of the tabletop and a second set of folding legs coupled to the underside of the tabletop at the right end of the tabletop;

wherein the first set of folding legs and the second set of folding legs are interspersed such that the first set of folding legs operate free of interference from the second set of folding legs and vice versa.

18. The convertible table with integrated storage according to claim 17 wherein an individual set of folding legs selected from the first set of folding legs and the second set of folding legs comprise one or more folding leg hinges, a first leg, a second leg, and one or more folding leg braces;

wherein the one or more folding leg hinges are operable to pivot the first leg and the second leg between a folding legs retracted position and a folding legs extended position;

wherein in the folding legs retracted position, the individual set of folding legs is oriented to be parallel to the tabletop;

wherein in the folding legs extended position, the individual set of folding legs is oriented to be perpendicular to the tabletop;

wherein the one or more folding leg braces are operable to lock the individual set of folding legs into the folding legs extended position.

* * * * *